US005566682A

United States Patent [19]

Yavitz

[11] Patent Number: 5,566,682

[45] Date of Patent: Oct. 22, 1996

[54] THERAPEUTIC SUPPORT DEVICE

[76] Inventor: Edward Q. Yavitz, 3828 Spring Creek Rd., Rockford, Ill. 61114

[21] Appl. No.: 514,429

[22] Filed: Aug. 11, 1995

[51] Int. Cl.[6] ..... A47G 9/00; A61B 19/00

[52] U.S. Cl. ..... 128/845; 5/636; 5/643

[58] Field of Search ..... 128/97.1, 845; 5/448, 464, 630, 636, 637, 643

[56] References Cited

U.S. PATENT DOCUMENTS

| | | | |
|---|---|---|---|
| 1,231,839 | 7/1917 | Berlin | 5/630 |
| 1,869,460 | 8/1932 | Brand | 606/240 |
| 2,314,080 | 3/1943 | Dine et al. | 128/845 |
| 2,521,780 | 9/1950 | Dodd | 5/644 |
| 2,764,150 | 9/1956 | Ettinger et al. | 5/630 |
| 2,839,766 | 6/1958 | Hull | 5/632 |
| 3,003,815 | 10/1961 | Zinn | 297/118 |
| 3,009,172 | 11/1961 | Eidam | 5/632 |
| 3,327,330 | 7/1967 | McCullough | 5/636 |
| 3,521,310 | 7/1970 | Greenawalt | 5/636 |
| 3,747,916 | 7/1973 | Benson | 5/600 |
| 3,967,335 | 7/1976 | Rhoads | 5/630 |
| 4,058,112 | 11/1977 | Johnson | 128/845 |
| 4,118,813 | 10/1978 | Armstrong | 5/337 |
| 4,571,761 | 2/1986 | Perlin | 128/845 |
| 4,908,892 | 3/1990 | Michelson | 5/431 |
| 4,969,222 | 11/1990 | Serola | 5/630 |
| 5,138,732 | 8/1992 | Wattie et al. | 5/636 |
| 5,199,124 | 4/1993 | Klemis | 5/630 |
| 5,201,761 | 4/1993 | Serola | 606/240 |
| 5,418,991 | 5/1995 | Shiflett | 5/650 |
| 5,454,781 | 10/1995 | Chitwood | 602/18 |

FOREIGN PATENT DOCUMENTS

| | | | |
|---|---|---|---|
| 1076118 | 10/1954 | France | 5/434 |
| 248635 | 3/1995 | United Kingdom | 5/636 |

*Primary Examiner*—V. Millin
*Assistant Examiner*—Eric P. Raciti
*Attorney, Agent, or Firm*—Foley & Lardner

[57] ABSTRACT

A device, particularly a contoured pillow, is disclosed for supporting the torso of a person. The pillow includes a top and a bottom separated by a side panel. The side panel is appropriately curved to provide a pair of shoulder support regions, a pair of scapula support regions and a sternum support region to permit a woman to rest or sleep with her chest facing downwardly without placing undue pressure on her breasts. The pillow is particularly designed as a therapeutic pillow for use after surgical procedures, such as breast enlargements or breast reductions. The various regions of the pillow are designed to support the person without placing undue stress on the areas which have undergone surgery.

19 Claims, 2 Drawing Sheets

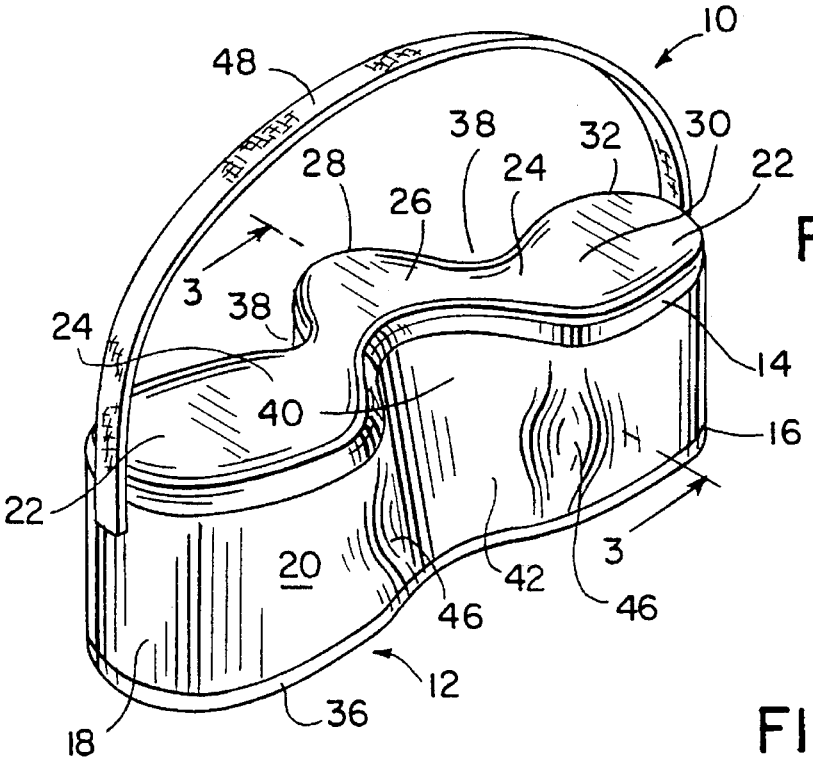
FIG. 1
FIG. 2
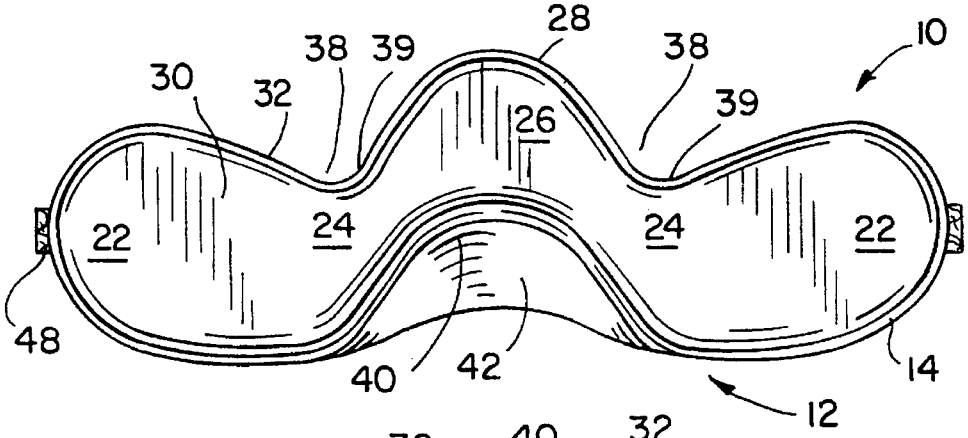
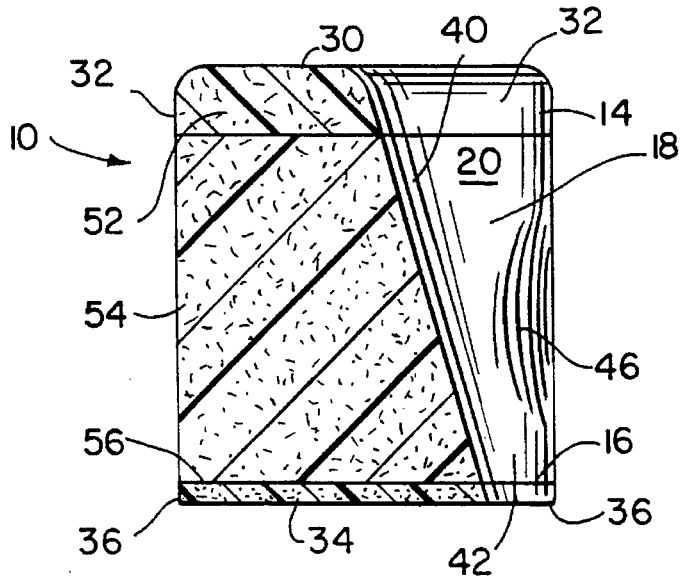
FIG. 3

FIG. 4
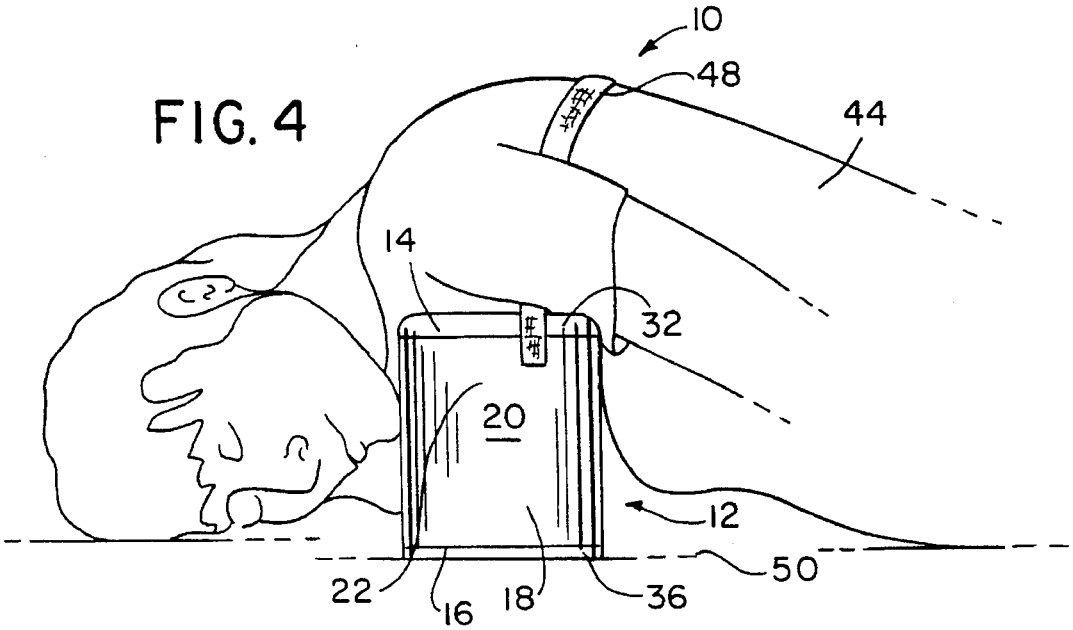
FIG. 5
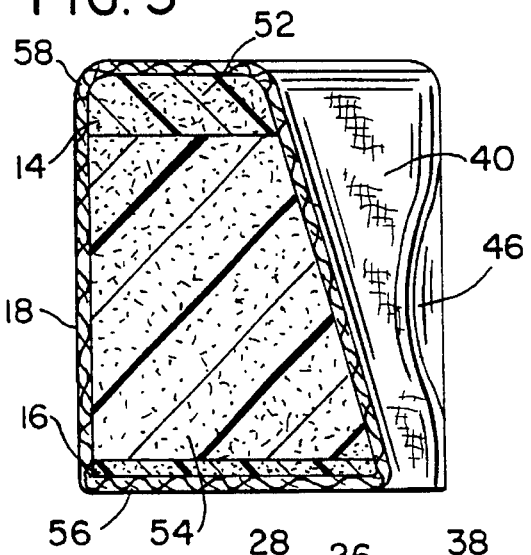
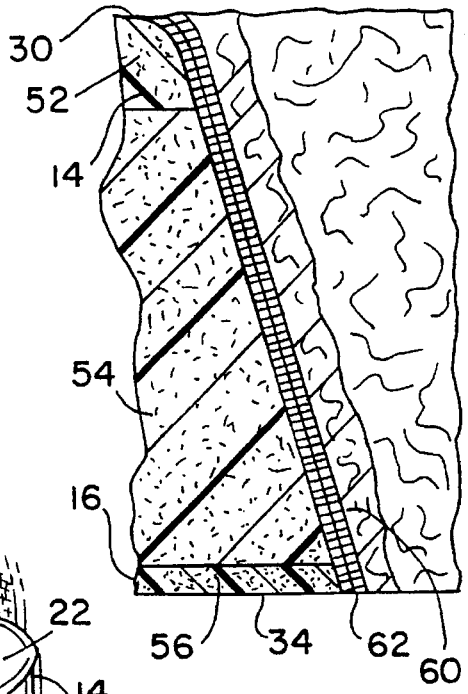
FIG. 7
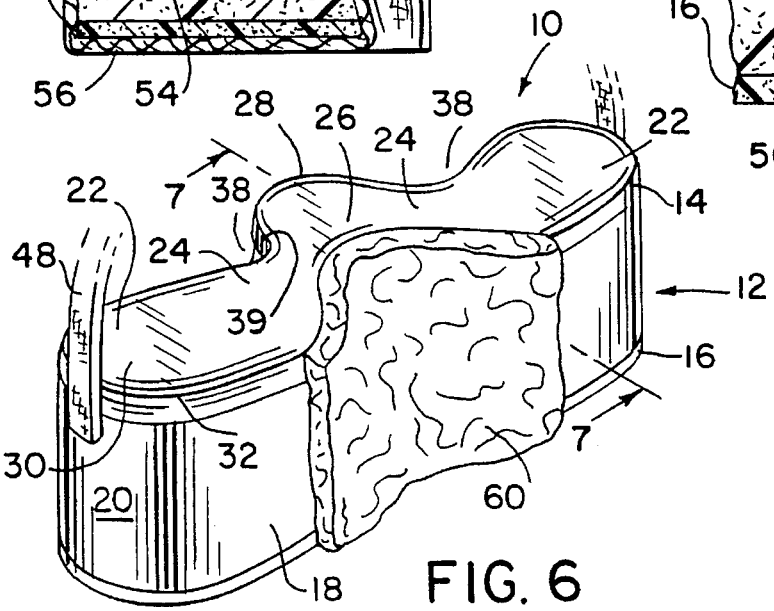
FIG. 6

THERAPEUTIC SUPPORT DEVICE

TECHNICAL FIELD

This invention relates generally to a therapeutic device contoured to provide desired support for a portion of the human body, and particularly to a therapeutic pillow designed for placement between a support surface, such as a bed, and a female patient's chest after having undergone a breast surgery.

BACKGROUND OF THE INVENTION

A variety of contoured devices or pillows have been designed to aid in therapy, sleep or relaxation. For example, some pillows are shaped to provide support for a person's neck. Other pillows are designed to provide lumbar support, and still others are designed to support a woman's abdominal and stomach areas during pregnancy. Often, such pillows provide support against specific areas of a person's body, while reducing the pressure exerted on other parts of the person's body by the support surface against which the person sits or lies.

Usually, such pillows are fairly conventional in design and use a cloth casing filled with a pillow filler material. Those pillows may be stitched together along a predetermined pattern to accentuate certain aspects.

Though some existing contoured pillows provide greater comfort or better rest, they are deficient in many applications. For example, many women undergo a variety of breast surgeries including breast reductions, breast enlargements, biopsies and numerous other surgical procedures. Following surgery, it is often uncomfortable for the woman to lie or sleep on her stomach. In fact, the healing process may even be slowed due to the pressure placed on the breasts if the woman sleeps or rests with her chest oriented downwardly. Therefore, it would be particularly advantageous to provide a contoured support device designed for placement between a bed and the chest area of a woman to reduce pressure otherwise applied against the person's breasts by a support surface, e.g. a mattress or bed.

SUMMARY OF THE INVENTION

The present invention includes a device for supporting at least a portion of a human torso. The device includes a pillow having a top and a bottom. The top is defined at least in part by an upper perimeter having a complex curvilinear shape. The bottom is similarly defined at least in part by a lower perimeter having a complex curvilinear shape. The top and bottom are connected along the upper perimeter and the lower perimeter at an edge configured to provide a pair of shoulder support regions, a pair of scapula support regions and a sternum support region. Each scapula support region is connected to an adjacent shoulder support region, while the sternum is connected between the scapula support regions. Furthermore, the sternum support region has a protruding portion that extends outwardly between a pair of recessed regions.

BRIEF DESCRIPTION OF THE DRAWINGS

The invention will hereafter be described with reference to the accompanying drawings, wherein like reference numerals denote like elements, and:

FIG. 1 is a perspective view of a contoured pillow device designed according to a preferred embodiment of the present invention;

FIG. 2 is a top view of the contoured pillow of FIG. 1;

FIG. 3 is a cross-sectional view taken generally along the line 3—3 of FIG. 1;

FIG. 4 is a side view of the pillow of FIG. 1 being used by a person sleeping on a support surface, such as a bed;

FIG. 5 is a cross-sectional view of an alternate embodiment of the contoured pillow device;

FIG. 6 is a perspective view of another alternate embodiment of the present invention; and FIG. 7 is a cross-sectional view taken generally along the lines 7—7 of FIG. 6.

DETAILED DESCRIPTION OF THE PREFERRED EMBODIMENT

Referring generally to FIGS. 1–3, a contoured pillow device 10 is illustrated as having a pillow portion 12. Pillow portion 12 has a top 14, a bottom 16 and an edge 18. Edge 18 includes an outer surface 20 that extends between top 14 and bottom 16 at least partially about the perimeter of pillow portion 12, and preferably about the entire perimeter.

Pillow portion 12 includes a shoulder support region 22 that preferably includes a pair of support regions, a scapula support region 24 that also preferably includes a pair of support regions, and a sternum support region 26. As illustrated, sternum support region 26 is located between scapula support regions 24 which, in turn, are located between shoulder support regions 22. Preferably, sternum support region 26, scapula support regions 24 and shoulder support regions 22 are integrally formed as a single pillow, but the various support regions could also be formed as independent or detachable regions. Furthermore, it is preferred that sternum support region 26 have a protruding portion 28 that extends outwardly from scapula support region 24 as shown in FIG. 2.

Top 14 includes an upper surface 30 and is defined at least in part by an upper perimeter 32 that preferably has a complex curvilinear shape. Similarly, bottom 16 has a lower surface 34 and is defined at least in part by a lower perimeter 36 preferably having a complex curvilinear shape. Top 14 and bottom 16 are connected along upper perimeter 32 and lower perimeter 36 by edge 18.

In the illustrated embodiment, outer surface 20 of edge 18 is of generally uniform height and extends the entire distance along upper perimeter 32 and lower perimeter 36. Preferably, upper surface 30 and lower surface 34 are generally flat and parallel to one another, but either or both of those surfaces could also be contoured. Additionally, outer surface 20 could vary in height between upper perimeter 32 and lower perimeter 36. In fact, upper perimeter 32 and lower perimeter 36 could be adjacent one another for at least part of the distance along the perimeter of pillow portion 12. For example, outer surface 20 could be formed to have its greatest expanse between upper perimeter 32 and lower perimeter 36 proximate protruding portion 28 and virtually no expanse at the ends of shoulder support regions 22.

Although the shape of upper perimeter 32, lower perimeter 36 and outer surface 20 can be changed for different uses or applications, the shape of the illustrated embodiment has proved to be desirable in facilitation the healing process of women who have undergone any of a variety of breast surgeries. In this design, each shoulder support region and scapula support region cooperate with protruding portion 28 of sternum support region 26 to create a recessed region 38 bounded by an arched portion 39 of outer surface 20 and configured to provide space for a breast of the patient when the patient lies with her chest against top 14 of pillow portion 12. Similar recessed regions 38 are disposed on both sides of protruding portion 28.

Additionally, a neck recess 40 is preferably formed in pillow portion 12 on an opposite side from protruding portion 28 as illustrated in FIG. 2. Neck recess 40 is recessed farther into pillow portion 12 proximate upper perimeter 32 than along lower perimeter 36 to create a sloped surface 42. Sloped surface 42 is designed to support the chin of a person or patient 44 as illustrated in FIG. 4. Neck recess 40 may also include additional relief areas 46, as best illustrated in FIG. 1, to permit the patient to more readily turn her head when using contoured pillow device 10.

An optional retainer 48 is attached to help hold pillow portion 12 in the appropriate position during use. A wide variety of retainers may be used. For example, a strap may be connected to pillow portion 12 and designed to extend about the torso of the patient as illustrated in FIG. 4. Thus, patient 44 would place pillow portion 12 on a support surface 50, such as a bed, lie with her chest against top 14 of pillow portion 12, and secure pillow portion 12 in place by wrapping retainer 48 about her torso. Strap 48 can be a single elastic strap or may include a fastener (not shown), such as a pair of metal rings, strip of hook and loop fasteners, e.g. Velcro™, or any of a variety of fasteners that would be known to those of ordinary skill in the art. Additionally, retainer 48 could take the form of straps designed to receive the arms of the patient rather than the torso.

Pillow portion 12 may be made from a variety of materials, but is preferably made from at least two layers of material. An upper layer 52 is disposed to contact the chest of patient 44 and is therefore preferably a softer material such as foam rubber. An exemplary material that works well is polyurethane foam, Product Code No. 2860 supplied by Polytech Foam Products of Milwaukee, Wis. A support layer 54 is disposed beneath upper layer 52 and preferably comprises a firmer material such as a polyurethane foam, Product Code Nos. 2870 or 4099 supplied by Polytech Foam Products of Milwaukee, Wis. However, support layer 54 could be made from a variety of materials that are adequately firm to substantially maintain their form under the weight of patient 44 when the patient is lying on pillow portion 12. Optionally, a thin soft base layer 56 may be attached to support layer 54 opposite uppermost layer 52 to help prevent the wearing of the support surface, e.g. bed, when contoured pillow device 10 is in use.

Uppermost layer 52 and support layer 54 are preferably laminated together with a glue, such as weldwood contact adhesvie supplied by Dap Industries, Inc. However, other adhesives and fastening methods, such as sewing or heat sealing, may work with some materials.

In an alternate embodiment illustrated in FIG. 5, an additional casing 58 is disposed about the exterior of pillow portion 12. Casing 58 may, for example, be made of cotton or a cotton-polyester blend and it functions primarily like a pillow casing that can be removed and washed after use.

In another embodiment illustrated in FIGS. 6 and 7, a pad 60 is attached to pillow portion 12 in neck recess 40 to provide a soft surface on which patient 44 may rest her chin. Pad 60 preferably comprises a relatively soft and comfortable material, such as sheepskin, foam rubber, or a lining stuffed with appropriate filler material. Pad 60 is preferably attached to pillow portion 12 by an appropriate fastener 62, such as the plurality of hooks and loops known by the trade name Velcro™, and illustrated in FIG. 7. Other fasteners, such as snaps or zippers, could also be used.

The dimensions of pillow portion 12 can be changed to accommodate persons of different sizes, but preferred exemplary dimensions are as follows: the overall thickness or height of pillow portion 12 between lower surface 34 and upper surface 30 is preferably at least four inches and most preferably approximately 6–8 inches. The overall length between the outer edges of shoulder support regions 22 is preferably at least 12 inches and most preferably approximately 15–17 inches. The neck recess is preferably at least five and most preferably approximately six inches at its widest point. Finally, the distance between the front of lower perimeter 36 at the outer most point of protruding portion 28 and the lower perimeter that forms the bottom of neck recess 40 is preferably at least three inches and most preferably approximately 4–6 inches. Also, according to one embodiment of the invention, upper layer 52 is approximately 1–3 inches thick and support layer 54 is approximately 4–6 inches thick.

It will be understood that the foregoing description is of a preferred exemplary embodiment of this invention and that the invention is not limited to the specific form shown. For example the shape of the pillow portion may be changed according to the size of the person or type of relief desired. The materials and dimensions of the pillow portion may also be adjusted according to the desired uses of the contoured pillow device. These and other modifications may be made in the design and arrangement of the elements without departing from the scope of the invention as expressed in the appended claims.

What is claimed is:

1. A device for supporting at least a portion of a torso of a person and for reducing pressure against the breasts of the person, comprising:

a pillow having a top and a bottom, the top being defined at least in part by an upper perimeter having a complex curvilinear shape, the bottom being defined at least in part by a lower perimeter having a complex curvilinear shape, the top and the bottom being connected along the upper and lower perimeter at an edge, the upper perimeter and top cooperating to provide:

a pair of shoulder support regions;

a pair of scapula support regions, each scapula support region being connected to an adjacent shoulder support region; and a sternum support region connecting the scapula support regions and having a protruding portion wherein the pair of shoulder support regions, pair of scapula support regions and sternum support regions cooperate to eliminate potentially harmful pressure against the breasts of the person.

2. The device as recited in claim 1, wherein the top includes a neck recess generally opposite the extended portion, the recess being configured to receive a neck of a person.

3. The device as recited in claim 1, wherein the pillow comprises at least two different materials disposed in a lower layer and an upper layer, the lower layer being stiffer than the upper layer.

4. The device as recited in claim 1, wherein the edge includes an outer surface spanning between the upper perimeter and the lower perimeter proximate the sternum support region, the outer surface having a pair of arches, each arch extending generally from the protruded portion to one of the shoulder support regions.

5. The device as recited in claim 4, further comprising a retainer configured to maintain the pillow against the torso.

6. The device as recited in claim 4, wherein the top has a top surface and the bottom has a bottom surface, the top and bottom surfaces being generally planar and parallel to one another.

7. The device as recited in claim 6, wherein the top surface is disposed at least four inches away from the bottom surface.

8. The device as recited in claim 4, wherein the pair of arches bound portions of the sternum support region, the pair of scapula regions and the pair of shoulder support regions.

9. The device as recited in claim 8, wherein the outer surface extends along the entire upper perimeter and lower perimeter.

10. A therapeutic pad for supporting the torso of a female person lying in a generally prostrate position with her chest oriented downwardly towards a bed, comprising:

a shoulder support;

a scapula support connected to the shoulder support; and a sternum support connected to the scapula support;

wherein the shoulder support, scapula support and sternum support are arranged to create a pair of recessed regions configured to at least partially receive the breasts of a female person when lying in the generally prostrate position; and wherein the retainer comprises a strap configured to extend about the torso.

11. A therapeutic pad for supporting the torso of a female person lying in a generally prostrate position with her chest oriented downwardly towards a bed, comprising:

a shoulder support;

a scapula support connected to the shoulder support; and a sternum support connected to the scapula support;

wherein the shoulder support, scapula support and sternum support are arranged to create a pair of recessed regions configured to at least partially receive the breasts of a female person when lying in the generally prostrate position; and wherein the shoulder support, the scapula support and the sternum support are integrally joined to form a top surface configured for placement against the torso, the top surface being bordered by an outer perimeter, the outer perimeter being curvilinear to define the pair of recessed regions, the sternum support extending outwardly between the recessed regions.

12. The therapeutic pad as recited in claim 11, wherein the top surface includes a recessed neck region.

13. The therapeutic pad as recited in claim 11, wherein the shoulder support, the scapula support and the sternum support each include a comfort layer for placement against the torso and a firmer support layer adjacent the comfort layer opposite to top surface.

14. A therapeutic pad for supporting the torso of a female person lying in a generally prostrate position with her chest oriented downwardly towards a bed to reduce pressure against her breasts otherwise exerted by the bed, comprising:

a shoulder support;

a scapula support connected to the shoulder support; and a sternum support connected to the scapula support;

wherein the shoulder support, the scapula support and the sternum support each comprise at least two laminated layers of different materials, the shoulder support, scapula support and sternum support all being bounded along a perimeter edge by an outer surface, the outer surface being indented at a pair of locations to accommodate a female person's breasts.

15. The therapeutic pad as recited in claim 14, further comprising a retainer designed to extend around a torso of a female person.

16. The therapeutic pad as recited in claim 14, wherein the outer surface includes a recessed neck region.

17. The therapeutic pad as recited in claim 14, wherein one of the laminated layers is a firm support layer and the other layer is a soft layer disposed above the firm support layer.

18. The therapeutic pad as recited in claim 17, wherein each layer is at least one inch thick.

19. The therapeutic pad as recited in claim 17, wherein each layer includes polyurethane foam.

* * * * *